United States Patent [19]

Lawrence

[11] Patent Number: 4,676,073

[45] Date of Patent: Jun. 30, 1987

[54] COOLING APPARATUS

[76] Inventor: Carl Lawrence, 8997 State Rte. 126, Loveland, Ohio 45140

[21] Appl. No.: 873,253

[22] Filed: Jun. 5, 1986

Related U.S. Application Data

[63] Continuation of Ser. No. 743,602, Jun. 11, 1985, abandoned.

[51] Int. Cl.[4] ..... F25D 17/00

[52] U.S. Cl. ..... 62/180; 62/228.3; 165/16

[58] Field of Search ..... 236/49; 165/16; 62/180, 62/228.3, 332, 203

[56] References Cited

U.S. PATENT DOCUMENTS

| | | | |
|---|---|---|---|
| 4,175,401 | 11/1979 | McManus | 62/180 |
| 4,244,193 | 1/1981 | Haakenson | 62/180 |
| 4,250,716 | 2/1981 | Huffman | 62/180 |
| 4,397,157 | 8/1983 | Keuch | 62/180 |

*Primary Examiner*—William E. Wayner

*Attorney, Agent, or Firm*—Frost & Jacobs

[57] ABSTRACT

Apparatus using outdoor air as a cooling medium for an enclosed space, including a single thermostat controlling a conventional mechanical refrigeration system and electric fan means, and a temperature sensor responsive to outdoor air temperature which is adapted to energize the thermostat, rendering it operative to deactivate the refrigeration system and to activate the fan means, thereby drawing outdoor air into the enclosed space when the outdoor air temperature is below a predetermined level.

7 Claims, 4 Drawing Figures

COOLING APPARATUS

This is a continuation of application Ser. No. 06/743,602, filed June 11, 1985, now abandoned.

BACKGROUND OF THE INVENTION

The present invention relates to cooling apparatus for an enclosed space using outdoor air as a cooling medium during cold weather. Although not so limited, the apparatus of the invention has particular utility in controlling temperature in dairy and produce cases, beverage and meat coolers and the like in supermarkets, meat cutting rooms, food processing and storage facilities, and similar enclosures wherein temperatures may require maintenance within a range of 20° to 55° F.

During winter months when outside air temperatures are below the required controlled temperature within an enclosed space of the type described above, the use of the apparatus of the invention permits deactivation of mechanical refrigeration systems with substantial savings in electrical energy. Calculations made by applicant indicate that the apparatus of the present invention would pay for itself within two to three months, based on a cost of 12 cents to 15 cents per kilowatt hour for electricity.

The use of ambient air for supplementary cooling has been proposed previously. However, none of the systems of which applicant is aware offers economy of operation and low installation cost comparable to the apparatus of the present invention.

U.S. Pat. No. 4,244,193 discloses a cooling system which includes a conventional mechanical refrigeration system and a first thermostat operative to actuate the refrigeration system at a predetermined upper temperature and to deactivate the system at a predetermined intermediate temperature; air flow passage means connecting the interior of an enclosure with the outdoors; fan means to draw ambient air into the enclosure through the air flow passage means; a second thermostat responsive to the temperature within the enclosure and operative to activate the fan means at the intermediate temperature and to deactivate the fan means at a predetermined low temperature below the intermediate temperature; and an outdoor temperature sensor responsive to ambient air temperature and operative to energize the second thermostat and render it operative to activate the fan means at a predetermined ambient temperature less than the intermediate temperature. Motorized damper means are positioned in the air flow passage means, the motorized damper means being connected in a control circuit with the second thermostat for actuation to an open position at the intermediate temperature level and for movement to a closed position at the low temperature level. An exhaust opening is also provided with motorized exhaust damper means, also connected in the control circuit with the second thermostat for actuation in the same manner as the motorized damper means positioned in the air flow passage means.

U.S. Pat. No. 4,250,716 discloses apparatus for use with conventional refrigeration systems, utilizing ambient air during cold weather. This system comprises a rectangular housing mounted within the space to be cooled having an end wall and side walls, an atmospheric air inlet in one of the housing walls, an atmospheric air outlet in another wall, a fan within the housing having an inlet port communicating with the air inlet and an outlet port communicating with the air outlet, an electric motor connected to the fan, first temperature sensing means mounted upon the housing sensing the temperature of the air within the space to be cooled, second temperature sensing means sensing atmospheric air temperature, control means on the housing electrically connected to the motor and first and second temperature sensing means adapted to energize the motor when the first sensing means indicates the need for cooling and when the second sensing means senses a predetermined atmosphereic temperature. The first temperature sensing means includes a first sensing bulb, and the second temperature sensing means is mounted within the housing and includes a second sensing bulb located within the atmospheric air inlet of the housing.

U.S. Pat. No. 4,358,934 discloses apparatus for utilizing atmospheric air to cool enclosures comprising a panel mounted upon the inner surface of the enclosure, an atmospheric air inlet in the panel, an enclosure air exhaust outlet in the panel, an exhaust fan mounted on the panel for direct communication with the enclosure for selectively exhausting air through the exhaust outlet, a first air duct having an end in alignment with and communicating with the panel inlet and a second end communicating with atmospheric air, an atmospheric air supply fan having an outlet in communication with the first air duct at the second end, a second air duct having a first end in alignment with and communicating with the exhaust outlet and a second end in communication with atmospheric air, and air temperature responsive fan control means electrically connected to the air supply and exhaust fans sensing the enclosure and atmospheric air temperatures so as to simultaneously energize the fans at predetermined enclosure and atmospheric temperature conditions. The fan control means is mounted on the panel intermediate the panel air inlet and exhaust outlet. This arrangement is not interconnected with a mechanical refrigeration system.

Despite the prior art systems disclosed in the above and earlier patents referenced therein, there is still a genuine need for a reliable, simplified air cooling system which can be inexpensively and easily connected to existing or new installations and which achieves substantial energy savings.

SUMMARY OF THE INVENTION

It is an object of the present invention to provide cooling apparatus using outdoor air as a cooling medium which fulfills the need described above.

This object is achieved by apparatus which includes a single thermostat controlling both a conventional refrigeration system and electric fan means, and a temperature sensor responsive to outdoor air temperature and adapted to energize the thermostat, rendering it operative to activate the fan means and deactivate the refrigeration system at predetermined temperature levels.

According to the invention there is provided cooling apparatus for an enclosed space including: a refrigeration system having a compressor, condenser, evaporator and thermostat, said evaporator and thermostat being within said enclosed space, said thermostat being adapted to activate said refrigeration system at a predetermined upper temperature and to deactivate said system at a predetermined lower temperature; an air inlet opening connecting said enclosed space with outdoor air; fan means adjacent said inlet opening and operative to draw outdoor air into said enclosed space through said inlet opening; a temperature sensor responsive to outdoor air temperature; first means energized by said sensor to activate said fan means when said outdoor air is below said lower temperature; and second means adapted to energize said thermostat and render it operative to deactivate said refrigeration system when said outdoor air is below said lower temperature; said second means being further adapted to deactivate said fan means when the air within said enclosed space reaches said lower temperature.

The apparatus of the invention preferably further includes damper means covering the inlet opening within the enclosed space, including self-closing louvers having a normally closed position, the louvers being responsive to air flow generated by the fan means, when activated, to pivot in unison automatically to an open position.

Preferably an exhaust opening is also provided in the enclosed space remote from the inlet opening, with exhaust damper means in the exhaust opening, including self-closing louvers responsive to slight superatmospheric pressure within the enclosed space to move the louvers to an open position.

DETAILED DESCRIPTION

Figure 1:
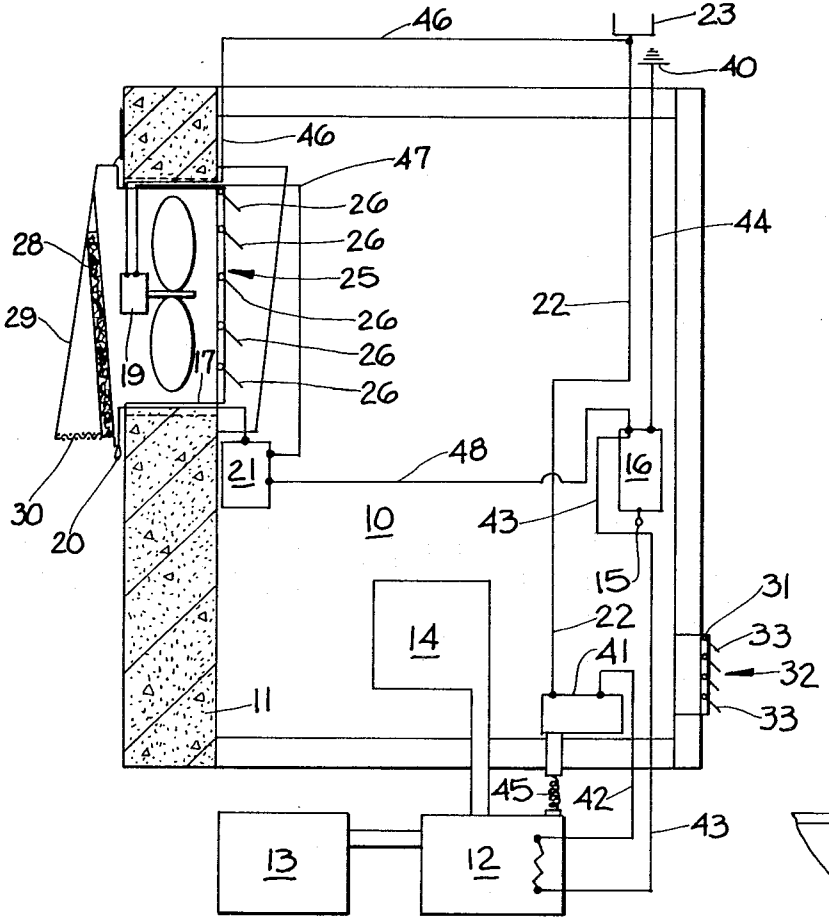
FIG. 1 is a diagrammatic illustration of the cooling apparatus of the present invention in combination with a conventional refrigeration system.

Reference is made to FIG. 1 wherein a space or enclosure to be cooled is indicated generally at 10. Such a space may be a walk-in type beverage cooler, meat storage room or the like, and in the exemplary showing of FIG. 1 an outside wall 11 is illustrated in vertical cross-section. A conventional mechanical refrigeration system is provided comprising a compressor indicated generally at 12, a condenser indicated generally at 13, an evaporator indicated generally at 14 and a thermostat indicated generally at 15, and a switch indicated generally at 16. The evaporator 14, thermostat 15 and switch 16 are positioned within the space 10. It will be understood that an electric motor (not shown) is provided to drive the compressor, and the compressor drive motor is controlled by thermostat 15 through a control circuit described hereinafter.

The refrigeration system described above is conventional and forms no part of the present invention except for the combination thereof with the outdoor air cooling system and inter-connected control of the two systems, which will now be described.

An inlet air opening 17 is provided in outside wall 11. Fan means 18 and an electric motor 19 are positioned adjacent the air inlet opening. By way of an exemplary showing, the fan 18 and motor 19 are positioned within the opening 17, but it will be understood that the fan and motor could be positioned slightly inwardly or outwardly of opening 17.

A temperature sensor responsive to outdoor air temperature is positioned outdoors as indicated at 20. This sensor is associated with a switch indicated generally at 21 within enclosed space 10, and an electrical circuit interconnects fan motor 19, sensor 20, switch 21, thermostat 15 and switch 16 with a source of electrical power shown at 23. This control circuit is explained in detail hereinafter.

Damper means is provided as shown generally at 25 covering inlet opening 17. Damper means 25 comprises a plurality of self-closing louvers 26 of known type, which are pivotally mounted to move in unison to normally closed position. The louvers 26 yield in response to air flow generated by fan means 18, when activated, thereby pivoting in unison to an open position. The louvers will close automatically when fan means 18 is deactivated.

An air filter indicated at 28 is provided on the outside of opening 17 in order to prevent entry of dust, bugs or extraneous material into the enclosed space 10. Preferably a downwardly sloping rain hood 29 is provided which shields the air filter 28 and inlet opening 17 from the elements. A screen indicated at 30 may be provided at the lower, entrance end of rain hood 29.

Since circulation of air within the enclosed space is generally desirable, and since only slight superatmospheric pressure is preferred, an exhaust opening is preferably provided, indicated at 31. This exhaust opening is remote from inlet opening 17, in order to permit circulation of outdoor air through space 10 before it is exhausted. Exhaust damper means indicated generally at 32 is provided in exhaust opening 31 which operates in a manner similar to that described above for the inlet opening damper means. Thus, self-closing louvers 33 which are in normally closed position, will pivot in unison to an open position when fan 18 is operating, due to slight superatmospheric pressure within space 10.

Figure 2:
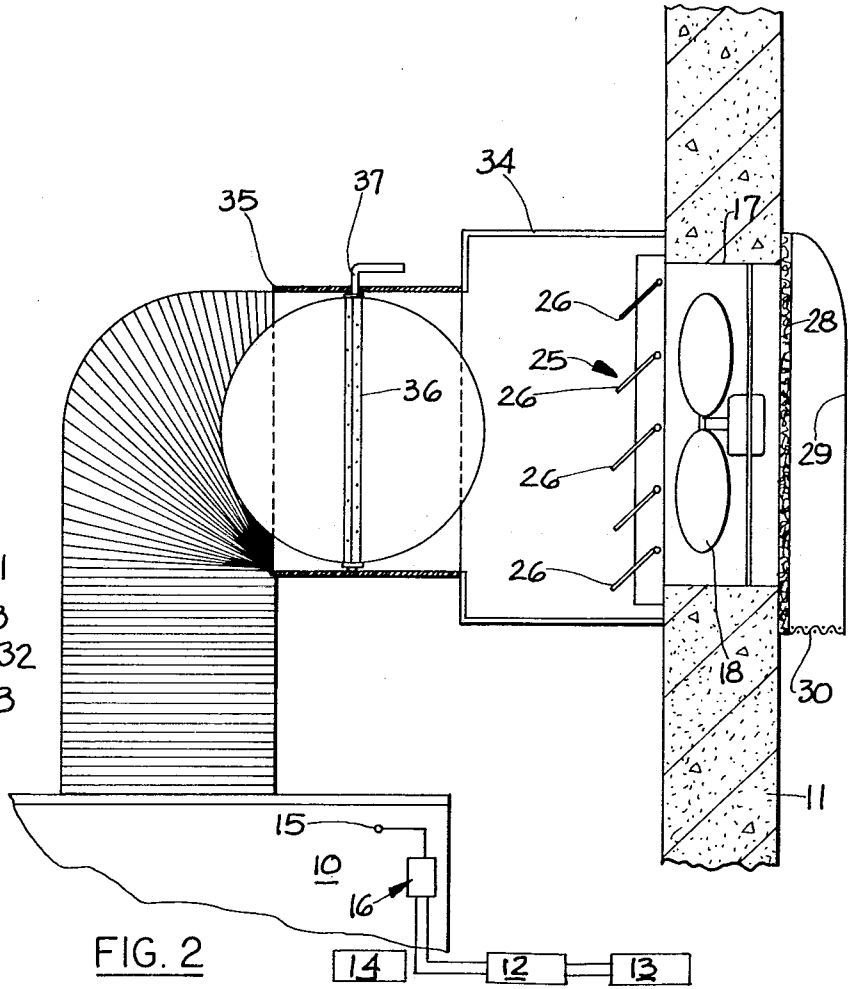
FIGS. 2 and 3 are diagrammatic illustrations of installations embodying the invention wherein an enclosed space to be cooled is within a building remote from a source of outdoor air.
Figure 3:
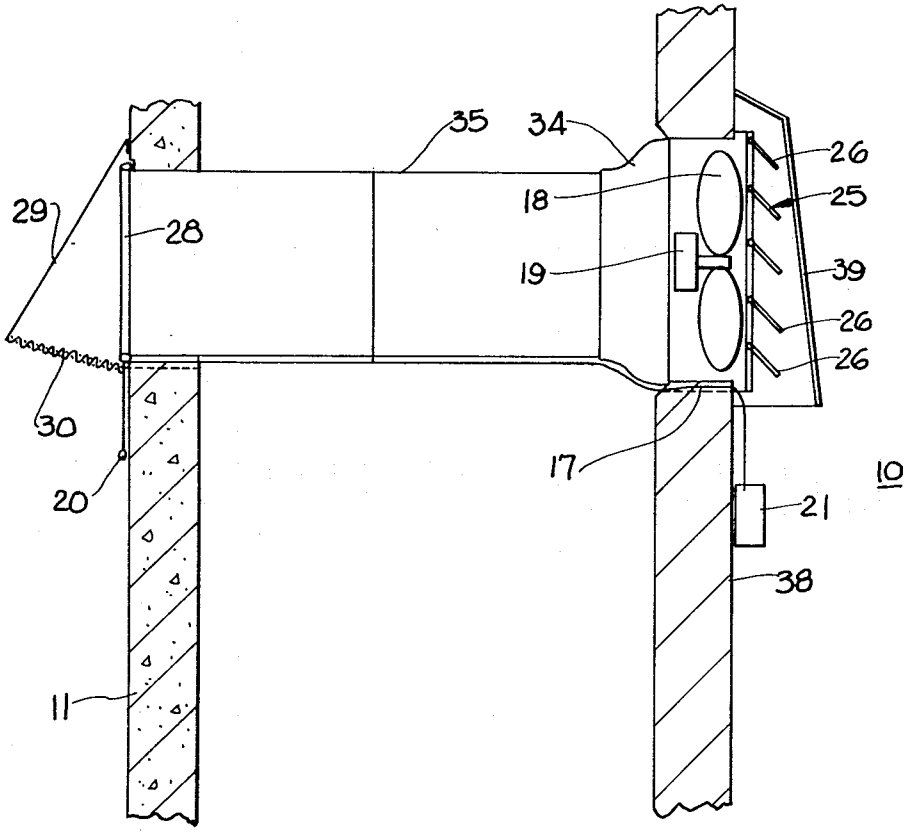

FIGS. 2 and 3 show installations embodying the invention in which the enclosed space which is to be cooled is remote from a source of outdoor air. In FIGS. 2 and 3 parts corresponding to like parts in FIG. 1 are given like reference numerals.

Referring to FIG. 2, an outside wall is indicated at 11, fan means 18 and its electric motor 19 are positioned in air inlet opening 17 in the same relative manner as shown in FIG. 1, while the damper means indicated generally at 25 comprises self-closing louvers 26, all of which function in the same manner as described above with respect to FIG. 1. It will be understood that the enclosure to be cooled in the installation indicated generally at 10 in FIG. 2 may be a high rise dairy case or the like in the interior of a supermarket, for example, and the case will be provided with a mechanical refrigeration system comprising a compressor, condenser, evaporator, thermostat and switch, the evaporator, thermostat and switch being positioned within the case as indicated at 14, 15 and 16, respectively, while the compressor and its associated electric motor, are shown schematically at 12, and the condenser at 13. A filter 28, protective hood 29 and screen 30 are also provided in the same manner as described above with respect to FIG. 1. Exhaust damper means may be provided as in the embodiment of FIG. 1.

A control circuit (not shown in Fig.2) interconnecting the mechanical refrigeration system with the outdoor air cooling system is the same as that shown in FIG. 1.

In the embodiment shown in FIG. 2, a plenum 34 is provided surrounding the inlet air damper means and conducting air drawn inwardly by fan 18 through the louvers, when opened, into duct means 35, which is preferably of circular cross section and will have a right-angle bend for convenience in conducting outdoor air downwardly into the dairy case 10. A damper is preferably provided within duct means 35 adjacent plenum 34, the damper being illustrated schematically at 36. A handle projecting externally of duct 35 is provided as shown at 37 for moving the damper means between open and closed positions. It will be understood that the damper will remain open throughout cold weather whenever there is a likelihood of utilizing outdoor air for cooling. Throughout summer weather the damper 36 is preferably moved to the closed position in order to avoid loss of cold air.

Referring to FIG. 3, an installation is illustrated wherein a room to be cooled is separated from a source of outdoor air by another room. In FIG. 3 an outside wall is indicated at 11, air inlet means at 17, fan means at 18, its electric motor at 19, air inlet damper means generally at 25, filter at 28, protective hood at 29 and screen at 30, all of which function in the same manner as corresponding elements in FIGS. 1 and 2.

An inside wall 38 is provided with an air inlet opening 17*a*, with fan means 18 and motor 19 being arranged therein. A plenum 34 and duct means 35 connect inlet opening 17 with a source of outdoor air which passes through screen 30 and filter 28, for discharge through louvers 26 when these are opened. A hood may be provided within the room to be cooled as indicated at 39 in order to deflect cold air downwardly after passing through louvers 26. A conventional mechanical refrigeration system (not shown) is provided in the same manner as described above for FIG. 1, and the controls and circuits (not shown) are the same. A damper similar to damper 36 in FIG. 2 may also be provided in duct means 35 of FIG. 3.

Figure 4:
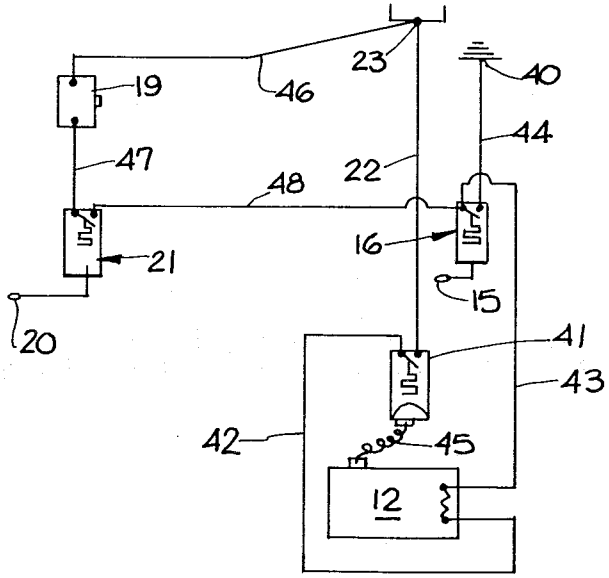
FIG. 4 is an electrical schematic of a control circuit used in the invention.

Referring to FIG. 4, the control circuits for the embodiments of FIGS. 1–3 are shown schematically. For the mechanical refrigeration system, line 22 connects power source 23 with a terminal of a pressure control switch 41, and a line 42 connects another terminal of switch 41 with the compressor motor 12. A connection to ground (indicated at 40) is provided from compressor 12 through line 43 to switch 16 and line 44. Such an arrangement is conventional and need not be described in detail other than to point out that compressor 12 will operate only when both switches 16 and 41 are closed. Pressure control switch 41 is operated by refrigerant pressure from the low side of compressor 12, a low side pressure tube 45 being provided between the compressor and pressure switch 41. The pressure setting to close switch 41 may be calibrated in terms of temperature if desired.

The control circuit for fan means 18 and its motor 19 includes outdoor air sensor 20, switch 21, a line voltage power source 46, a line 47 from fan motor 19 to switch 21, and a line 48 connecting switches 21 and 16, thereby providing a connection to ground.

The manner of operation is as follows:

If it is desired to maintain a temperature of, e.g. 40° F., in enclosed space 10, outdoor air control switch 21 is set to close at about 35° F, and inside control switch 16 is set to close at about 40° F. and to open at 35° F. When the outside air temperature is 35° F. or lower, switch 21 will thus close responsive to the low side compressor pressure which corresponds with the enclosed air temperature; said third means being energized when the air temperature reaches an upper temperature; and the circuit for fan motor 19 will be completed (through lines 46, 47, switch 21, line 48, switch 16 and line 44). Under these conditions it is possible that the compressor circuit will also be completed. However, pressure control switch 41 will be set at a pressure corresponding to a temperature of about 45° F., so that entry of cold outside air would within a short time lower the temperature within space 10 to a level where pressure control switch 41 would open, thus inactivating compressor 12. If the outside air temperature is substantially below 35° F., switch 16 would open when the temperature within space 10 reaches 35° F., thus shutting off fan motor 19. As the temperature within space 10 gradually rises thereafter, switch 16 would again close, reactivating fan motor 19. This cycling of the fan means would continue as long as the outdoor air temperature is below about 35° F., and the mechanical refrigeration system would remain inactivated.

I claim:

1. Cooling apparatus for an enclosed space including a refrigeration system having a compressor, condenser, evaporator and a thermostat, said evaporator and thermostat being within said enclosed space, said thermostat being adapted to activate said refrigeration system at a predetermined upper temperature and to deactivate said system at a predetermined lower temperature within said enclosed space; an air inlet opening connecting said enclosed space with outdoor air; fan means adjacent said inlet opening and operative to draw outdoor air into said enclosed space through said inlet opening; a temperature sensor responsive to outdoor air temperature; first means energized by said sensor when said outdoor air is below said lower temperature; second means adapted to be energized when the enclosed air reaches a specified temperature; and a third means responsive to the low side compressor pressure which corresponds with the enclosed air temperature; said third means being energized when the air temperature reaches an upper temperature; said second and third means being interconnected in a circuit with said compressor to operate said refrigeration system when said second and third means are energized by the enclosed air temperature, whereby to activate said refrigeration system; said first and second means being interconnected in a circuit with said fan means which is completed when said first means is energized by said sensor and when said second means is energized by said specified temperature, whereby to activate said fan means; said second means being further adapted to deactivate said fan means when the air within said enclosed space reaches said lower temperature.

2. The apparatus claimed in claim 1, including damper means covering said inlet opening within said enclosed space, said means including self-closing louvers having a normally closed position, said louvers being responsive to air flow generated by said fan means, when activated, to pivot in unison to an open position.

3. The apparatus claimed in claim 1, including an air filter in said opening positioned between said fan means and outdoor air.

4. The apparatus claimed in claim 1, including an exhaust opening in said enclosed space remote from said inlet opening, exhaust damper means in said exhaust opening, said means including self-closing louvers having a normally closed position, said louvers being responsive to slight superatmospheric pressure within said enclosed space to pivot in unison to an open position.

5. The apparatus claimed in claim 2, including an exhaust opening in said enclosed space remote from said inlet opening, exhaust damper means in said exhaust opening, said means including self-closing louvers having a normally closed position, said louvers being responsive to slight superatmospheric pressure within said enclosed space to pivot in unison to an open position.

6. The apparatus claimed in claim 1, wherein said enclosed space is within a building and is remote from a source of outdoor air, and including duct means interconnecting said inlet air opening with outdoor air.

7. The apparatus claimed in claim 6, including damper means in said duct means intermediate said inlet air opening and outdoor air, and means for moving said damper means between open and closed positions.

* * * * *